US007140082B2

(12) United States Patent
Chen

(10) Patent No.: US 7,140,082 B2
(45) Date of Patent: Nov. 28, 2006

(54) SIDE RELEASE BUCKLE ALLOWING LOCKING FROM AN ANGULAR POSITION

(75) Inventor: Tsung-Lung Chen, Taipei (TW)

(73) Assignee: Button International Co., Ltd., Taipei (TW)

( * ) Notice: Subject to any disclaimer, the term of this patent is extended or adjusted under 35 U.S.C. 154(b) by 0 days.

(21) Appl. No.: 11/033,396

(22) Filed: Jan. 12, 2005

(65) Prior Publication Data

US 2006/0150376 A1 Jul. 13, 2006

(51) Int. Cl.
*A44B 11/25* (2006.01)

(52) U.S. Cl. ..... 24/625; 24/615; 24/614; 24/616; 24/627

(58) Field of Classification Search ..... 24/615, 24/614, 625; D11/216
See application file for complete search history.

(56) References Cited

U.S. PATENT DOCUMENTS 5,465,472 A * 11/1995 Matoba ..... 24/625
6,052,875 A * 4/2000 Fudaki ..... 24/625
6,148,486 A * 11/2000 Uehara et al. ..... 24/170
6,622,355 B1 * 9/2003 Buscart et al. ..... 24/615

* cited by examiner

*Primary Examiner*—Robert J. Sandy
*Assistant Examiner*—Marcus Menezes
(74) *Attorney, Agent, or Firm*—Troxell Law Office, PLLC

(57) ABSTRACT

A side release buckle includes a male member having two forward extended elastic retaining arms, each of which has a curved outer sidewall with a retaining shoulder portion formed near a proximal end thereof and a downward locating block; and a hollow female member having a front opening and two side openings, and two projected stoppers. The curved outer sidewalls of the retaining arms enable the male member to slide into the front opening of the female member from an angular position, and the engagement of the male member with the female member at the retaining shoulder portions and axially front ends of the side openings and at the locating blocks and the stoppers provides the buckle with enhanced force-bearing strength to prevent the male and the female member from easy breakaway.

8 Claims, 7 Drawing Sheets

SIDE RELEASE BUCKLE ALLOWING LOCKING FROM AN ANGULAR POSITION

FIELD OF THE INVENTION

The present invention relates to a side release buckle allowing locking from an angular position, and more particularly to a side release buckle having a male member adapted to quickly insert into a female member from an angular position, and non-breakaway structures adapted to prevent the buckle from being easily opened under an unexpected pull.

BACKGROUND OF THE INVENTION

Side release buckles are widely employed on various apparels and articles, such as backpacks, to detachably connect two ends of a fastening belt. Such buckles usually include a male and a female member connected to the two ends of the fastening belt. By engaging or disengaging the male and female members with or from each other, or depressing or releasing a push element, the two ends of the fastening belt could be connected or separated under control. In addition to control the connection or separation of the two ends of the fastening belt, the buckle also serves as a major supporting means when the fastening belt is subjected to an external force.

In a conventional side release buckle as shown in FIG. 1, the male member A typically includes an insert head having two spaced elastic retaining arms A1, and the female member B a front opening B1 corresponding to the insert head and two side openings B2. When the male member A is inserted into the front opening B1 of the female member B and reaches at the two side openings B2, the two spaced elastic retaining arms A1, which are initially compressed inward by the front opening B1 of the female member B, elastically spring into the two side openings B2 due to a restoring force to firmly hold the male member A to the female member B. When it is desired to open the buckle, simply apply two opposite inward forces on the two elastic retaining arms A1 exposed from the side openings B2 to cause separation of the elastic retaining arms from the side openings B2, and then pull the male member A out of the female member B.

The male member A of the above-described conventional side release buckle could be inserted into the female member B only when the two members are generally aligned with each other. The buckle just could not be locked when the male member A is in an angular or biased position relative to the female member B. It is necessary to re-align the male and the female member A, B to lock the side release buckle. The buckle tends to become worn easily when the male and the female member A, B are frequently misaligned and repeatedly operated to lock the buckle.

Moreover, a main force-bearing structure on the conventional side release buckle to prevent the locked male and female members A, B from unexpected separation from each other includes two axially front ends of the two side openings B2 of the female member B, upon which the two outward sprung elastic retaining arms A1 of the male member A abut. Since the two elastic retaining arms A1 elastically exposed from the side openings B2 are subject to inward compression and deformation to easily separate from the axially front ends of the side openings B2, the buckle tends to open unexpectedly to cause inconveniences or even dangers.

SUMMARY OF THE INVENTION

A primary object of the present invention is to provide a side release buckle allowing locking from an angular position, so that a male member of the buckle could be inserted into a female member from an angular position.

Another object of the present invention is to provide a side release buckle that has a male member adapted to insert into a female member from an angular position and a first non-breakaway structure to provide the buckle with enhanced force-bearing strength to prevent the male and the female member from easy breakaway due to an unexpected pull of the buckle.

A further object of the present invention is to provide a side release buckle that has a male member adapted to insert into a female member from an angular position and a second non-breakaway structure to provide the buckle with enhanced force-bearing strength to prevent the male and the female member from easy breakaway due to an unexpected pull of the buckle.

To achieve the above and other objects, the side release buckle allowing locking from an angular position according to the present invention mainly includes:

a male member having two spaced elastic retaining arms forward extended from a front end thereof, each of the elastic retaining arms having a curved outer sidewall that is elastically movable under a pressure, and a retaining shoulder portion being formed near a proximal end of each curved outer sidewall; and a hollow female member having a front opening corresponding to the elastic retaining arms of the male member and having an inner wall surface adapted to compress and guide the curved outer sidewalls on the male member into the female member, and two side openings provided at two lateral sides of the female member to communicate with the front opening; and the two side openings having axially front ends adapted to abut against the retaining shoulder portions at the proximal ends of the curved outer sidewalls on the male member.

A first one of the two elastic retaining arms includes an extended arm that has a predetermined area and is laterally extended from an inner side of the curved outer sidewall of the retaining arm, and a first locating block is downward projected from a tip of the extended arm. And, a second one of the two elastic retaining arms is provided near and below a distal end of the curved outer sidewall with a downward projected second locating block.

The curved outer sidewalls of the two elastic retaining arms respectively have a tip or distal end formed of a bevel angle, so that a clearance is left between the two opposing bevel angles to prevent the elastic retaining arms from contacting or colliding with each other when they are inward compressed.

The female member is provided on a bottom behind the front opening with two projected stoppers for engaging with the first and the second locating block on the two elastic retaining arms of the male member.

The male and the female member are provided at respective rear end with a long transverse slot, through which two free ends of a fastening belt are extended to connect the buckle to the fastening belt.

With the curved outer sidewalls of the elastic retaining arms, the male member of the side release buckle of the present invention could be inserted into the female member via the front opening from an angular position; and, with the inward compression of the two elastic retaining arms by the inner wall surface of the front opening of the female member when the male member is angularly inserted into the female member, the male member could be quickly guided to a straight forward moving direction into the female member. When the male and the female member are engaged with each other, the retaining shoulder portions on the male member and the axially front ends of the side openings on the female member together provide the first non-breakaway structure for the buckle. And, when the male member is continuously subjected to a pull to result in an elastic deformation of the female member, the first and the second locating block on the male member and the stoppers on the female member together provide the second non-breakaway structure for the buckle of the present invention. That is, there are two non-breakaway structures in the buckle of the present invention to largely enhance the force-bearing strength of the buckle,

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
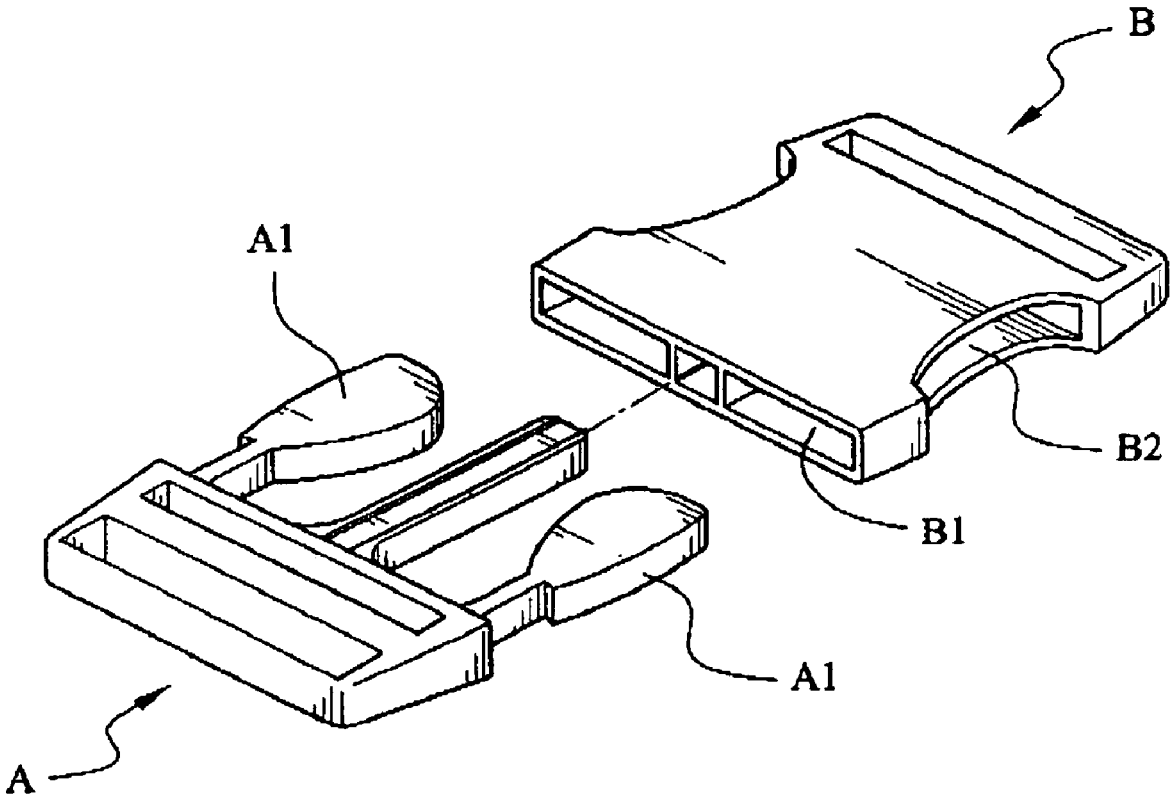
FIG. 1 (Prior Art)
FIG. 1 is an exploded perspective view of a conventional side release buckle.
Figure 2:
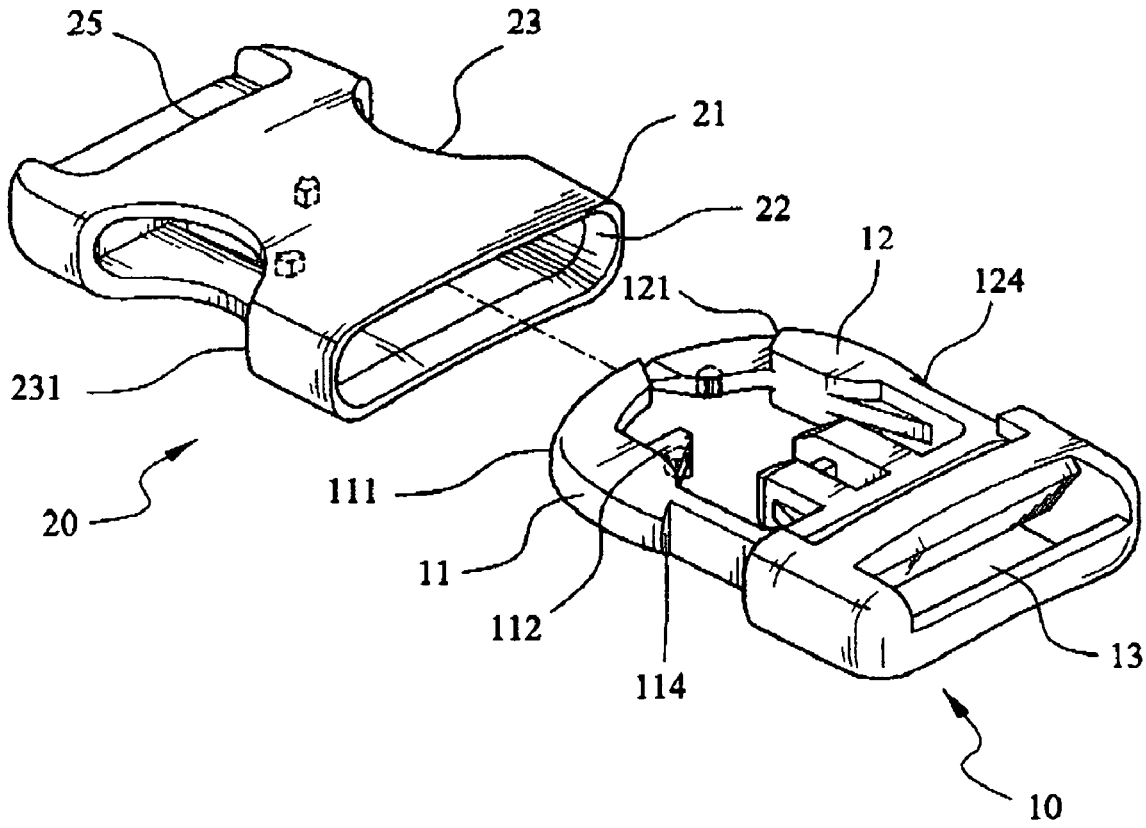
FIG. 2 is an exploded top perspective view of a side release buckle allowing locking from an angular position according to an embodiment of the present invention.
Figure 3:
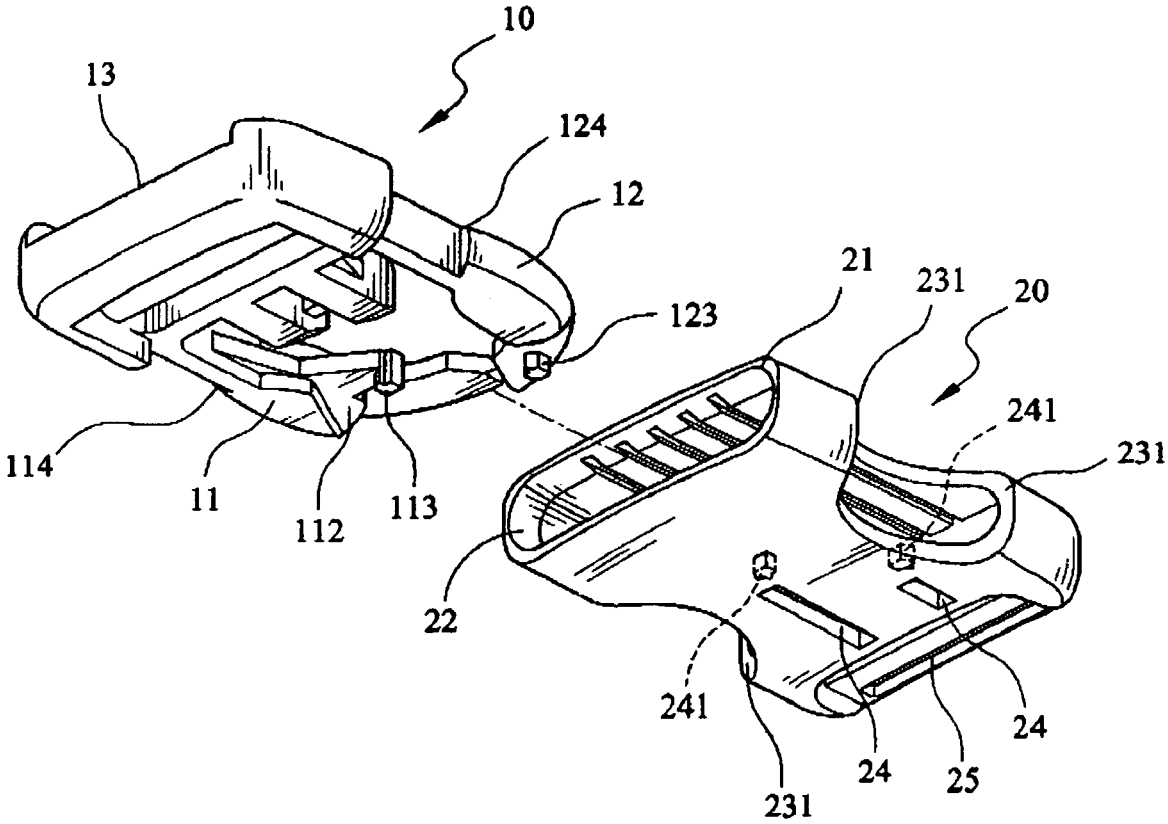
FIG. 3 is an exploded bottom perspective view of the side release buckle allowing locking from an angular position shown in FIG. 2.
Figure 4:
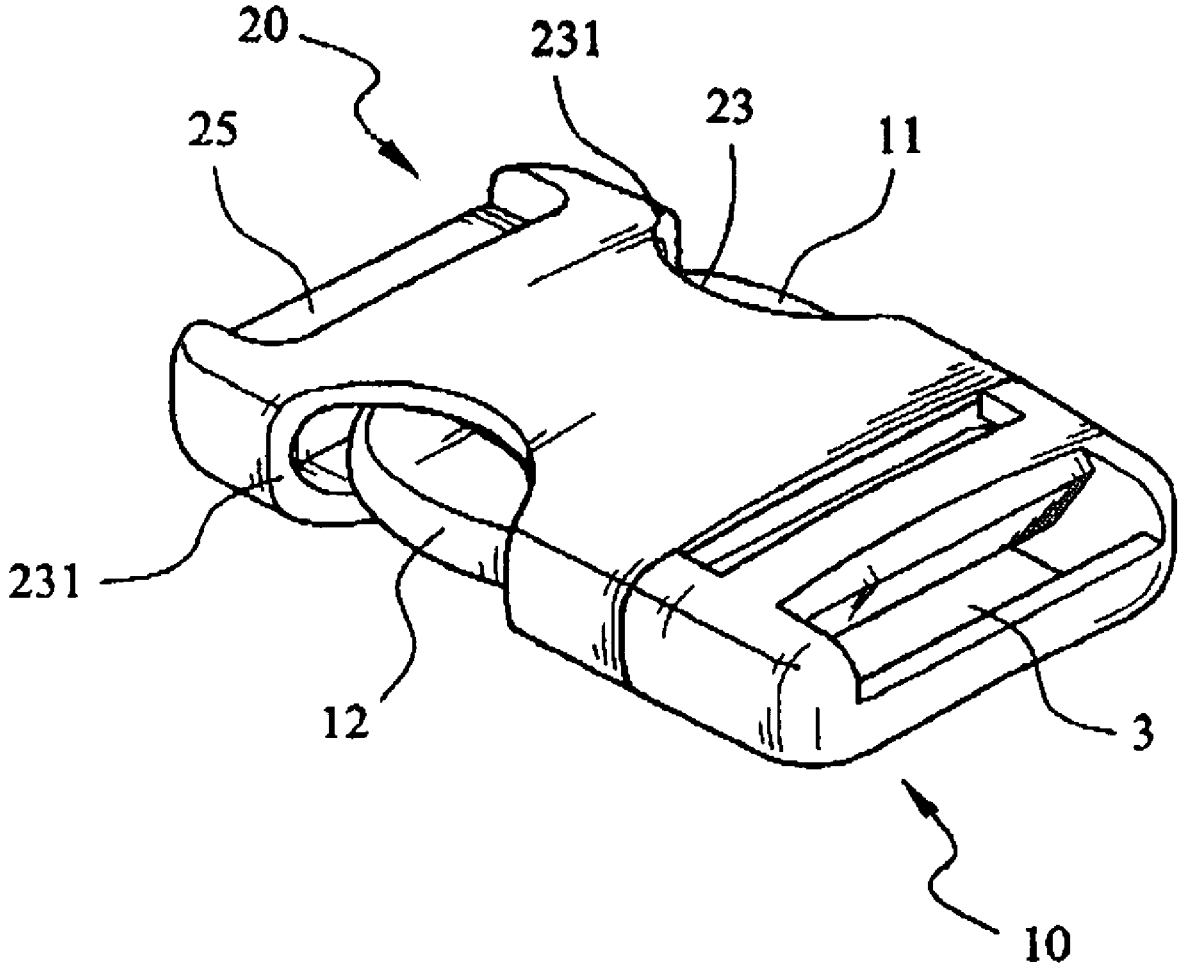
FIG. 4 is an assembled perspective view of FIG. 2.

Please refer to FIGS. 2, 3, and 4 in which a side release buckle allowing locking from an angular position according to a preferred embodiment of the present invention is shown. For the purpose of concision, the side release buckle allowing locking from an angular position is also briefly referred to as "the buckle" and "the side release buckle" throughout the specification. As shown, the buckle includes a male member 10 having two spaced elastic retaining arms 11, 12 forward extended from a front end thereof, and a hollow female member 20 having a front opening 21 corresponding to the two retaining arms 11, 12 of the male member 10. The male and the female member 10, 20 are provided at respective rear end with a long transverse slot 13, 25, through which two free ends of a fastening belt (not shown) are extended to thereby connect the buckle to the fastening belt.

The elastic retaining arms 11, 12 of the male member 10 have curved outer sidewalls 111, 121, respectively, which allow the retaining arms 11, 12 to extend into the front opening 21 of the female member 20 from an angular position. Two retaining shoulder portions 114, 124 are separately formed near a proximal end of the curved outer sidewalls 111, 121 of the two retaining arms 11, 12.

In addition to the front opening 21 that has an inner wall surface 22 capable of compressing and guiding the elastic retaining arms 11, 12 of the male member 10 into the front opening 21, the female member 20 is also provided at two lateral sides with two side openings 23 to communicate with the front opening 21. The two side openings 23 have an axially front end 231, against which the retaining shoulder portions 114, 124 are abutted when the male member 10 is fully inserted into the female member 20.

An extended arm 112 having a predetermined area laterally extends from an inner side of the curved outer sidewall 111 of the retaining arm 11, and has a first locating block 113 downward projected from a tip thereof.

Meanwhile, the retaining arm 12 is provided near and below a distal end of the curved outer sidewall 121 with a downward projected second locating block 123.

Figure 5:
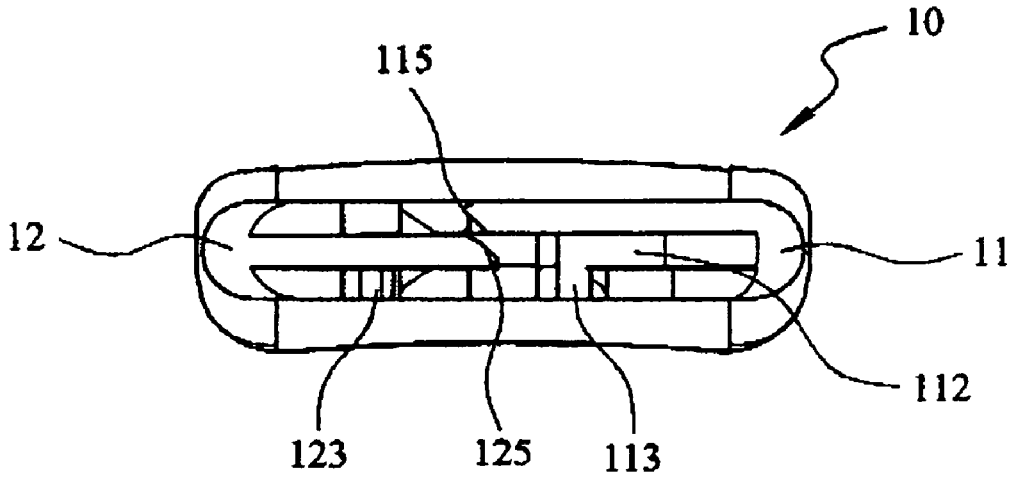
FIG. 5 is a front view of a male member of the side release buckle of the present invention.

Please refer to FIG. 5. The curved outer sidewalls 111, 121 respectively have a tip or distal end formed of a bevel angle 115, 125, so that a clearance is left between the two opposing bevel angles to prevent the elastic retaining arms 11, 12 from contacting or colliding with each other when they are inward compressed.

As can be clearly seen from FIG. 3, two projected stoppers 241 are formed on a bottom of the female member 20 at predetermined positions behind the front opening 21 for engaging with the first and the second locating block 113, 123 on the retaining arms 11, 12. The female member 20 is also formed immediately behind the two stoppers 241 with two guide slots 24 for mould unloading after the stoppers 241 are injection molded.

Figure 6:
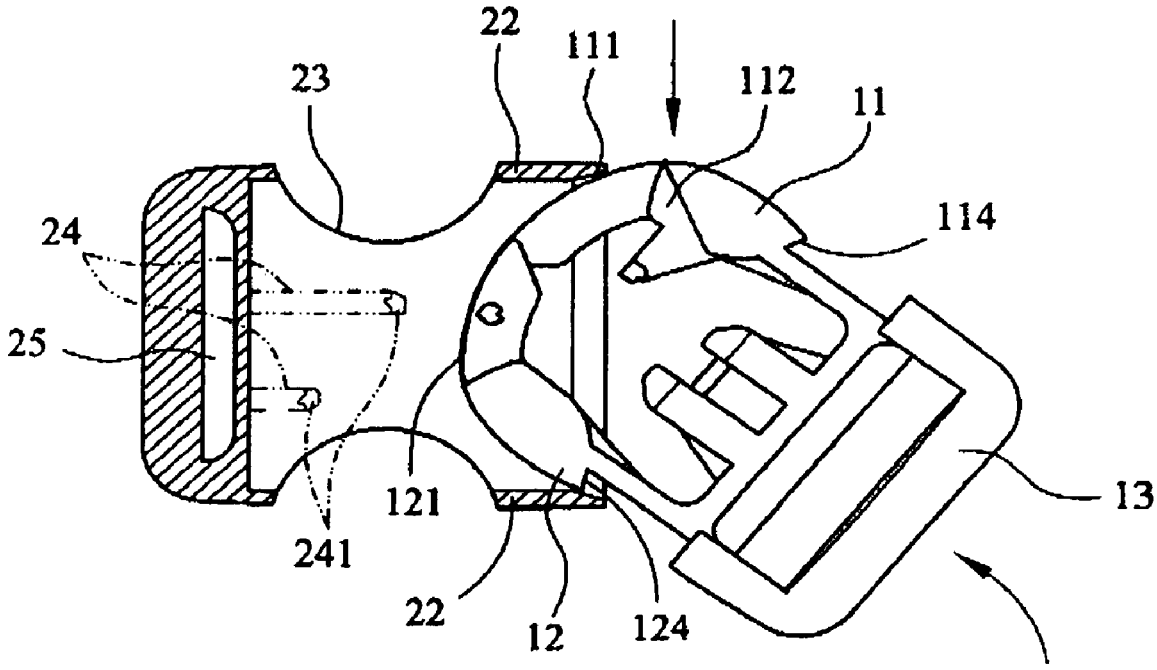
FIG. 6 shows the male member of the side release buckle of the present invention is initially inserted into a female member at an arbitrary angle.
Figure 7:
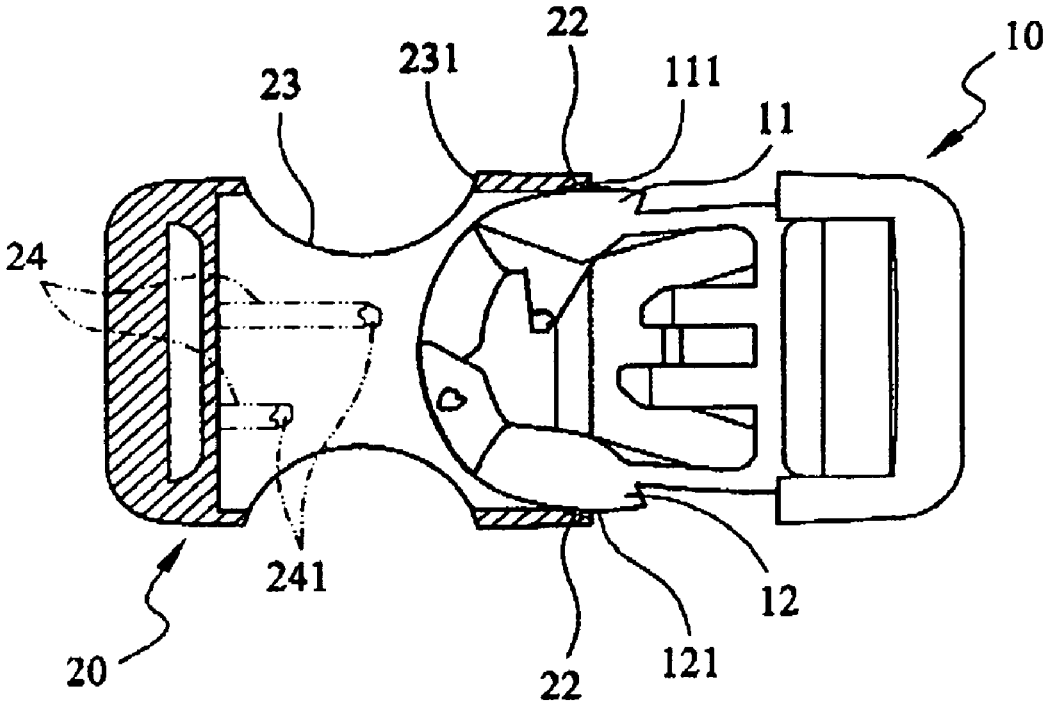
FIG. 7 shows the male member of the side release buckle of the present invention has been further inserted into the female member to align with the female member.
Figure 8:
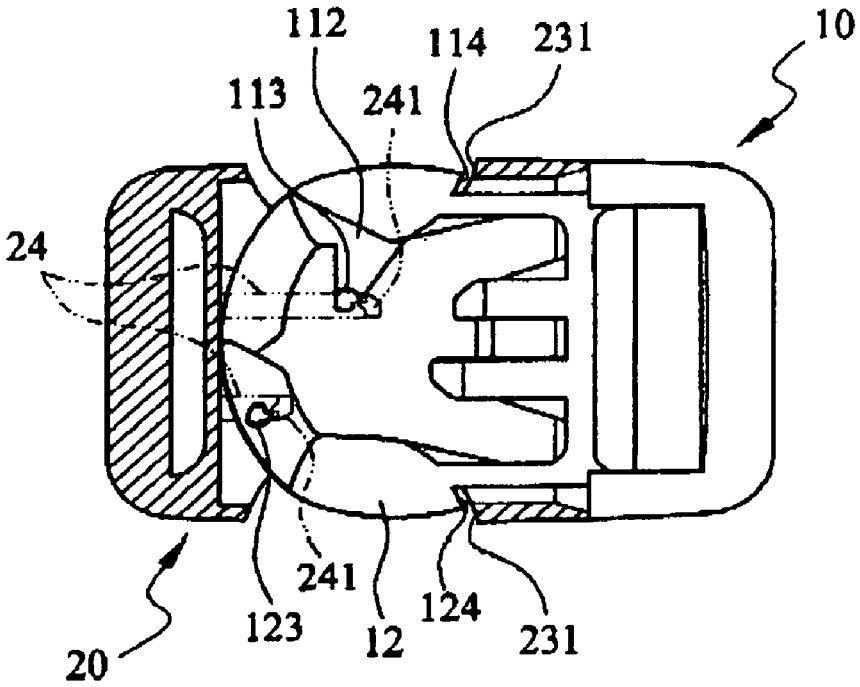
FIG. 8 shows the side release buckle of the present invention with male and female members thereof in a fully engaged state.

FIGS. 6 and 7 shows the manner in which the male member 10 is inserted into the female member 20. When the male member 10 is initially inserted into the female member 20 via the front opening 21 at an arbitrary angle, as shown in FIG. 6, the elastically movable curved outer sidewalls 111, 121 of the two elastic retaining arms 11, 12 in contact with the inner wall surface 22 of the front opening 21 of the female member 20 are inward compressed and guided to a straight forward moving direction, allowing the male member 10 to easily slide into the front opening 21, as shown in FIG. 7. When the male member 10 has been fully moved into the female member 20, as shown in FIG. 8, the curved outer sidewalls 111, 121 are located adjacent to the side openings 23 of the female member 20 and immediately spring into the side openings 23 due to a restoring force of the elastic retaining arms 11, 12. At this point, the retaining shoulder portions 114, 124 near the proximal ends of the curved outer sidewalls 111, 121 are also elastically moved to abut on the axially front ends 231 of the side openings 23 and thereby hold the male member 10 to the female member 20.

When the curved outer sidewalls 111, 121 of the retaining arms 11, 12 of the male member 10 spring into the side openings 23 of the female member 20, the first and the second locating block 113, 123 of the retaining arms 11, 12 are shifted sideward at the same time to finally closely locate behind the two stoppers 241 in the female member 20 without contacting with them, as can be clearly seen from FIG. 8.

Figure 9:
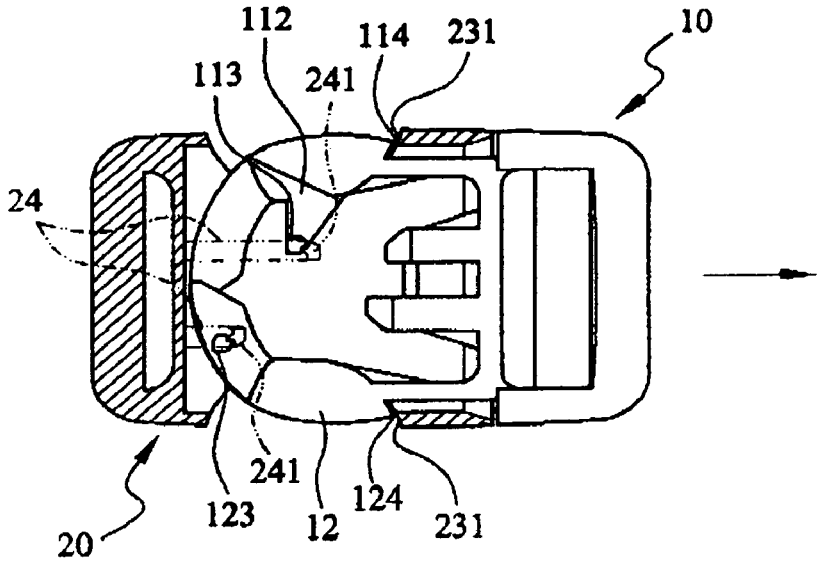
FIG. 9 shows the side release buckle of the present invention with the male member thereof subjected to a pull.
Figure 10:
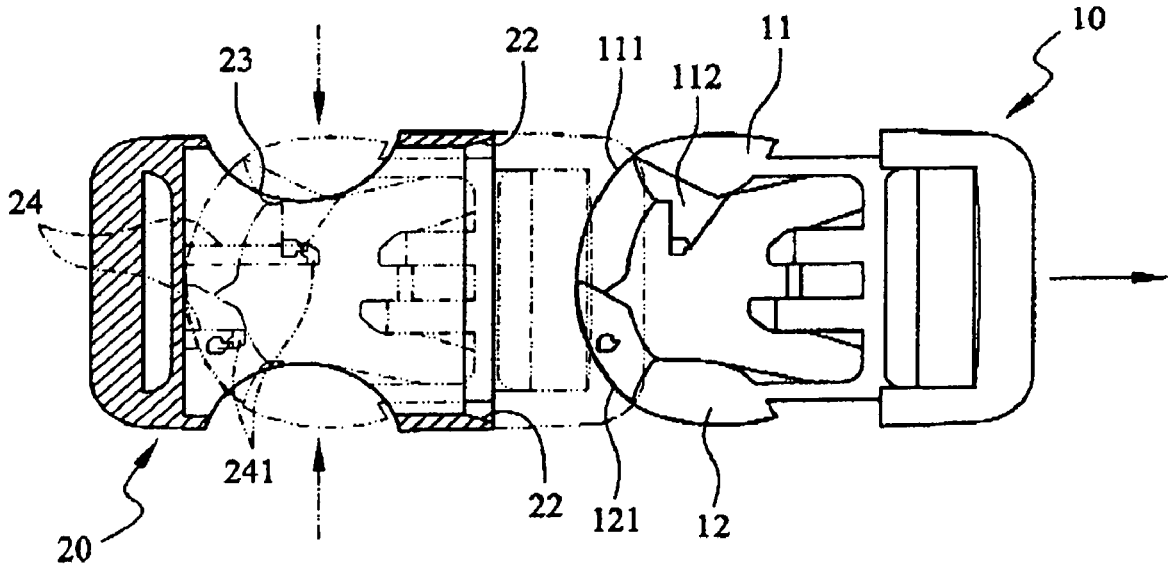
FIG. 10 shows the manner of disengaging the male member of the side release buckle of the present invention from the female member.

When the male member 10 inserted into the female member 20 is unexpectedly subjected to an outward pull as shown in FIG. 9, the retaining shoulder portions 114, 124 of the male member 10 are brought to tightly press against the axially front ends 231 of the two side openings 23 to provide the buckle with a first non-breakaway structure. At this point, the first and the second locating block 113, 123 are still located behind the two stoppers 241 without getting in contact with them. However, when the outward pull applied on the male member 10 continues to finally elastically stretch and deform the female member 20, the locating blocks 113, 123 on the male member 10 are also moved rearward to firmly engage with the two stoppers 241 to provide the buckle with a second non-breakaway structure. Therefore, the buckle of the present invention has a largely increased force-bearing strength to prevent the male member 10 from easily separating from the female member 20 due to a pull applied on the male member 10.

When it is desired to disengage the male member 10 from the female member 20 and thereby open the buckle, simply depress the curved outer sidewalls 111, 121 of the elastic retaining arms 11, 12 that are exposed from the side openings 23 of the female member 20, and the two elastic retaining arms 11, 12 could be quickly moved backward through the inner wall surface 22 of the front opening 21 and pulled out of the female member 20.

With the curved outer sidewalls 111, 121 of the elastic retaining arms 11, 12, the male member 10 of the buckle of the present invention could be inserted into the female member 20 via the front opening 21 from an angular position; and, with the inward compression of the two elastic retaining arms 11, 12 by the inner wall surface 22 of the front opening 21 of the female member 20 when the male member 10 is angularly inserted into the female member 20, the male member 10 could be quickly guided to a straight forward moving direction into the female member 20. When the male and the female member 10, 20 are engaged with each other, the retaining shoulder portions 114, 124 on the male member 10 and the axially front ends 231 of the side openings 23 on the female member 20 together provide the first non-breakaway structure for the buckle. And, when the male member 10 is continuously subjected to a pull to result in an elastic deformation of the female member 20, the first and second locating blocks 113, 123 on the male member 10 and the stoppers 241 on the female member 20 together provide the second non-breakaway structure for the buckle of the present invention. That is, there are total four resisting points on the buckle of the present invention to largely enhance the force-bearing strength of the buckle.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A side release buckle allowing locking from an angular position, comprising:

a male member having two elastic retaining arms spaced apart and extending outwardly from a front end thereof, each of said two elastic retaining arms having a curved outer sidewall that is elastically movable under a pressure, and a retaining shoulder portion being formed near a proximal end of each said curved outer sidewall, each of the two elastic retaining arms has a first end connected to the male member and a second end located on an end the two retaining arms are both located in a non-vertical command plane, a lower surface of the first end of a first retaining arm of the two elastic retaining arms the first end of a second retaining arm of the two elastic retaining arms; is located and extending over an upper surface of and a hollow female member having a front opening corresponding to said elastic retaining arms of said male member and having an inner wall surface adapted to compress and guide each curved outer sidewall of said male member into said female member, and two side openings provided at two lateral sides of said female member to communicate with said front opening; and each of said two side openings having an axially front end adapted to abut against said retaining shoulder portions at the proximal end of said curved outer sidewall of each of the two elastic retaining arms of the male member.

2. The side release buckle allowing locking from an angular position as claimed in claim 1, wherein the first retaining arm of said two elastic retaining arms includes an extended arm that has a predetermined area and is laterally extended from an inner side of said curved outer sidewall of said retaining arm.

3. The side release buckle allowing locking from an angular position as claimed in claim 2, wherein said extended arm has a first locating block downward projected from a tip thereof.

4. The side release buckle allowing locking from an angular position as claimed in claim 3, wherein the second retaining arm of said two elastic retaining arms is provided below a distal end of said curved outer sidewall thereof with a downward projected second locating block.

5. The side release buckle allowing locking from an angular position as claimed in claim 1, wherein each curved outer sidewall has a tip having a beveled angle.

6. The side release buckle allowing locking from an angular position as claimed in claim 4, wherein said female member is provided on a bottom at predetermined positions behind said front opening with two projected stoppers for engaging with said first and said second locating block on said two elastic retaining arms of said male member.

7. The side release buckle allowing locking from an angular position as claimed in claim 1, wherein said male member is provided at a rear end with a long transverse slot, through which a first one of two free ends of a fastening belt is extended to connect said male member to said fastening belt.

8. The side release buckle allowing locking from an angular position as claimed in claim 7, wherein said female member is provided at a rear end with a long transverse slot, through which a second one of said two free end of said fastening belt is extended to connect said female member to said fastening belt.

* * * * *